US009227748B2

(12) United States Patent
Nakagawa et al.

(10) Patent No.: US 9,227,748 B2
(45) Date of Patent: Jan. 5, 2016

(54) METAL BOTTLE CAN

(75) Inventors: Masayuki Nakagawa, Toyama (JP); Osamu Kume, Toyama (JP); Yoshio Asai, Toyama (JP)

(73) Assignee: TAKEUCHI PRESS INDUSTRIES CO., LTD., Toyama (JP)

( * ) Notice: Subject to any disclaimer, the term of this patent is extended or adjusted under 35 U.S.C. 154(b) by 1111 days.

(21) Appl. No.: 13/259,247

(22) PCT Filed: Apr. 6, 2010

(86) PCT No.: PCT/JP2010/056267

§ 371 (c)(1),
(2), (4) Date: Sep. 23, 2011

(87) PCT Pub. No.: WO2010/117009

PCT Pub. Date: Oct. 14, 2010

(65) Prior Publication Data

US 2012/0024813 A1 Feb. 2, 2012

(30) Foreign Application Priority Data

Apr. 6, 2009 (JP) ..... 2009-091910
Jul. 16, 2009 (JP) ..... 2009-167686
Nov. 5, 2009 (JP) ..... 2009-253801

(51) Int. Cl.
*B65D 1/02* (2006.01)
*B65D 1/40* (2006.01)

(52) U.S. Cl.
CPC ..... *B65D 1/0207* (2013.01); *B65D 1/0246* (2013.01)

(58) Field of Classification Search
CPC ..... B65D 1/023; B65D 1/0246
USPC ..... 215/40, 42, 43, 44
See application file for complete search history.

(56) References Cited

U.S. PATENT DOCUMENTS

| | | | | |
|---|---|---|---|---|
| 5,718,352 | A * | 2/1998 | Diekhoff et al. | 220/669 |
| 5,755,354 | A * | 5/1998 | Lang | 220/689 |
| 6,010,028 | A * | 1/2000 | Jordan et al. | 220/669 |
| 6,264,050 | B1 * | 7/2001 | Darr et al. | 215/40 |
| 6,543,636 | B1 * | 4/2003 | Flecheux et al. | 220/288 |
| 6,959,830 | B1 * | 11/2005 | Kanou et al. | 220/288 |
| 2003/0102278 | A1 * | 6/2003 | Chupak | 215/40 |
| 2004/0173560 | A1 * | 9/2004 | Chupak | 215/40 |
| 2007/0051687 | A1 * | 3/2007 | Olson | 215/44 |
| 2008/0011702 | A1 * | 1/2008 | Walsh | 215/44 |
| 2008/0047922 | A1 * | 2/2008 | Olson et al. | 215/40 |
| 2008/0301799 | A1 * | 12/2008 | Arnold et al. | 726/14 |

* cited by examiner

*Primary Examiner* — Mickey Yu
*Assistant Examiner* — Niki Eloshway
(74) *Attorney, Agent, or Firm* — Browdy and Neimark, PLLC

(57) ABSTRACT

A metal bottle can comprises a mouth part having a curl portion at the end, a neck part having a straight part in parallel to the can axis, a taper-shaped shoulder part, a barrel part, and a bottom part. The metal bottle can is integrally formed from a primitive plate of the thickness (wall thickness T) of 0.48 mm to 0.30 mm by drawing-processed. The metal bottle can has the barrel part with the diameter A of 40 mm to 70 mm, the neck part with the diameter B of 20 mm to 35 mm, the straight portion of the neck part with the length S of 10 mm to 40 mm, the shoulder part with the angle α of 40 degrees to 70 degrees, the mouth part with the wall thickness X of 0.46 mm to 0.33 mm, and straight portion of the neck part with the wall thickness Y of 0.43 mm to 0.30 mm.

13 Claims, 11 Drawing Sheets

METAL BOTTLE CAN

CROSS REFERENCE TO RELATED APPLICATIONS

This application claims the priority benefit of Japanese applications Nos. 2009-253801, filed Nov. 5, 2009, 2009-167686, filed Jul. 16, 2009 and 2009-091910, filed Apr. 6, 2009. The present application is also a 35 U.S.C. §371 National Phase conversion of International (PCT) Patent Application No. PCT/JP2010/56267, filed on Apr. 6, 2010.

FIELD OF THE INVENTION

This invention relates to a metal bottle can in which an easily openable cap is wound and fastened to a mouth part, or a cap is screwed to a male screw portion of the mouth part. For more detail, it relates to a metal bottle can for easy holding, in which the balance of thinning and weight reduction are attained while maintaining the necessary strength.

BACKGROUND ARTS

Conventionally, various metal bottle cans in which beer, refreshing liquid etc. is filled are produced and sold in the market, and are used by general consumers. For such metal containers, a plate member of aluminum alloy, for example, a primitive plate of the thickness 0.5 mm or more of plate material 3104-H19 etc. is used. The mouth part, shoulder part, barrel part, and bottom part are integrally formed by drawing processing, necking processing. An easily openable cap opened by pulling a pull tab is wound and fastened to the mouth part of the metal bottle can, or a screw cap which is capable of resealing the mouth part after taking off the seal, is screwed to the mouth part of the meal bottle can for protecting contents. Conventional metal bottle cans have inadequacy of generating buckling in the neck part, the shoulder part or the barrel part, caused by a downward load applied along the can axis, and generating deformation in the mouth part caused by a load applied in the direction of crushing a curl portion. The loads are applied when forming the curl portion in the mouth part of the metal bottle can, when winding and fastening an easily openable cap, or when capping a screw cap. Hence, conventional metal bottle cans having the mouth part, shoulder part, or barrel part of which the wall thickness is thick wholly have been manufactured using a thick primitive plate material. In case when the thin primitive plate material is used from the very beginning, the strength of the mouth part, shoulder part, or barrel part will be inadequate. Conventionally, there has been no such a metal bottle can, where the wall thickness of a strength-required portion is made thick, where the wall thickness of a strength-not-required portion is made thin, and where the size of the neck part being long. As the patent document of a conventional metal bottle can, Patent Document 1 is known.

PRIOR ART DOCUMENTS

Patent Documents

Patent Document 1: Published Japanese Patent Application No. S56-183155.

PROBLEMS TO BE SOLVED

However, recently from the world wide requirements of resource saving, and from the request of cost down of metal bottle cans etc. by bottling companies, a metal bottle can in which the thickness is thinned has been proactively investigated. However, the thinning of each part of a metal bottle can in a single uniform way for the purpose of cost down may causes the lowering of the strength of the metal bottle can, and may leads the fault forming of curl of the mouth part and the male screw portion. It is apparent that unconsidered thinning will cause the deterioration of quality of the metal bottle cans. In other words, metal bottle cans attaining cost down are demanded in which the necessary portions have strength with a proper wall thickness, and in which the unnecessary portion is thinned, presuming reasonable metal bottle cans. The present invention is devised focusing attention on such problems, and is directed to provide a thinned reasonable metal bottle can having a sufficient strength to withstand a load applied when forming a curl portion, a load applied when winding and fastening an easily openable cap, or a load applied when capping a screw cap. More specifically, the present invention is to provide a metal bottle cap in which the mouth part, the neck part, or the barrel part maintains a sufficient strength not to generate deformation, buckling in the manufacturing process or in the filling process of contents, and to provide a metal bottle can being not deformed, being not depressed in each stage of transportation, sale, or consumption as a product, and being easy to hold and easy to handle, while attaining the balance of thinning and weight reduction.

DISCLOSURE OF INVENTION

The present invention of claim 1 is a metal bottle can which comprises a mouth part having a curl portion at an end, a neck part having a straight portion in parallel to a can axis, a shoulder part having a tapered shape, a barrel part, and a bottom part. The diameter A of the barrel part is 40 mm to 70 mm, a diameter B of the neck part is 20 mm to 35 mm, a length S of the straight portion of the neck part is 10 mm to 40 mm, an angle $\alpha$ of the shoulder part is 40 degree to 70 degree, a wall thickness X of the mouth part is 0.46 mm to 0.33 mm, and a wall thickness Y of the straight portion of the neck part is 0.43 mm to 0.30 mm. The metal bottle can is integrally formed by drawing a primitive plate of thickness (wall thickness T) of 0.48 mm to 0.30 mm.

The claim 2 of the present invention is a metal bottle can, in which a wall thickness Z of the shoulder part is 0.22 mm to 0.12 mm and a wall thickness W of the barrel part is 0.22 mm to 0.12 mm.

The claim 3 of the present invention is a metal bottle can, in which the wall thickness X' of the curl portion is 0.48 mm to 0.35 mm, the angle $\theta$ between the straight line portion of the curl portion and a horizontal line is $0 \leq \theta \leq 25$ degrees, the radius of a curvature R of the lower portion of the curl portion is $0.5\text{ mm} \leq R \leq 1.0$ mm, or in which the wall thickness X' of the curl portion is 0.48 mm to 0.35 mm, the angle $\theta'$ between the straight line portion of the curl portion and the horizontal line is $0 \leq \theta' \leq 25$ degrees, the radius of the curvature R' of the lower portion of the curl portion is $0.5 \leq R \leq 1.0$ mm.

The claim 4 of the present invention is a metal bottle can, in which an easily openable cap is wound and fastened to the curl portion.

The claim 5 of the present invention is a metal bottle can, in which the outer diameter C of a annular recessed portion of the mouth part is smaller than a diameter B of the straight portion of the neck part, so that a tongue piece which connects a top surface wall of an easily openable cap and a pull tab is placed along a wall surface of the annular recessed portion of the mouth portion of the metal bottle can.

The claim 6 of the present invention is a metal bottle can, in which the diameter of the straight portion of the neck part is lengthened to the lower portion of the curl portion.

The claim 7 of the present invention is a metal bottle can which comprises a mouth part having a curl portion at an end and a male screw portion formed at a periphery, a neck part having a straight portion in parallel to a can axis, a shoulder part having a tapered shape, a barrel part, and a bottom part. The diameter A of the barrel part is 40 mm to 70 mm, an angle α of the shoulder part is 40 degree to 70 degree, a wall thickness E of the mouth part is 0.45 mm to 0.32 mm, and a wall thickness F of the straight portion of the neck part is 0.40 mm to 0.30 mm. The metal bottle can is integrally formed by drawing a primitive plate of thickness (wall thickness T) of 0.48 mm to 0.30 mm.

The claim 8 of the present invention is a metal bottle can, in which the metal bottle can has a neck part which does not have a straight portion in parallel to the can axis.

The claim 9 of the present invention is a metal bottle can, in which the wall thickness G of the shoulder part having the tapered shape is 0.33 mm to 0.20 mm, and the wall thickness H of the barrel part is 0.22 mm to 0.12 mm.

The claim 10 of the present invention is a metal bottle can which comprises a mouth part having a curl portion at the end, a neck part having a tapered shape, a shoulder part having a tapered shape, a barrel part, and a bottom part. The diameter A of the barrel part is 40 mm to 70 mm, an angle β of the shoulder part is 50 degree to 89 degree, a wall thickness O of the mouth part is 0.46 mm to 0.33 mm, and a wall thickness Y of the neck part having tapered shape is 0.43 mm to 0.30 mm. The metal bottle can is integrally formed by drawing a primitive plate of thickness (wall thickness T) of 0.48 mm to 0.30 mm.

The claim 11 of the present invention is a metal bottle can in which the wall thickness Q of the shoulder part having tapered shape is 0.33 mm to 0.20 mm, and the wall thickness U of the barrel part is 0.22 mm to 0.12 mm.

EFFECT OF THE INVENTION

The metal bottle can of the present invention has an effect to have a sufficient strength to withstand a load applied when forming the curl portion, a load applied when winding and fastening the easily openable cap, or a load applied when capping the screw cap. And, it has an effect to be capable of providing a reasonable metal bottle can at a cheap cost, in which the balance of thinning and weight reduction is attained, while maintaining the strength. Further, it has an effect that it will not deform, or it will not depress in each stage of transportation, sale, or consumption as a product. Further, the metal bottle can of the present invention is easy to hold and easy to handle.

BEST MODE FOR CARRYING OUT THE INVENTION

The one example of the embodiment of the present invention is hereinafter described based on the drawings.

Figure 1:
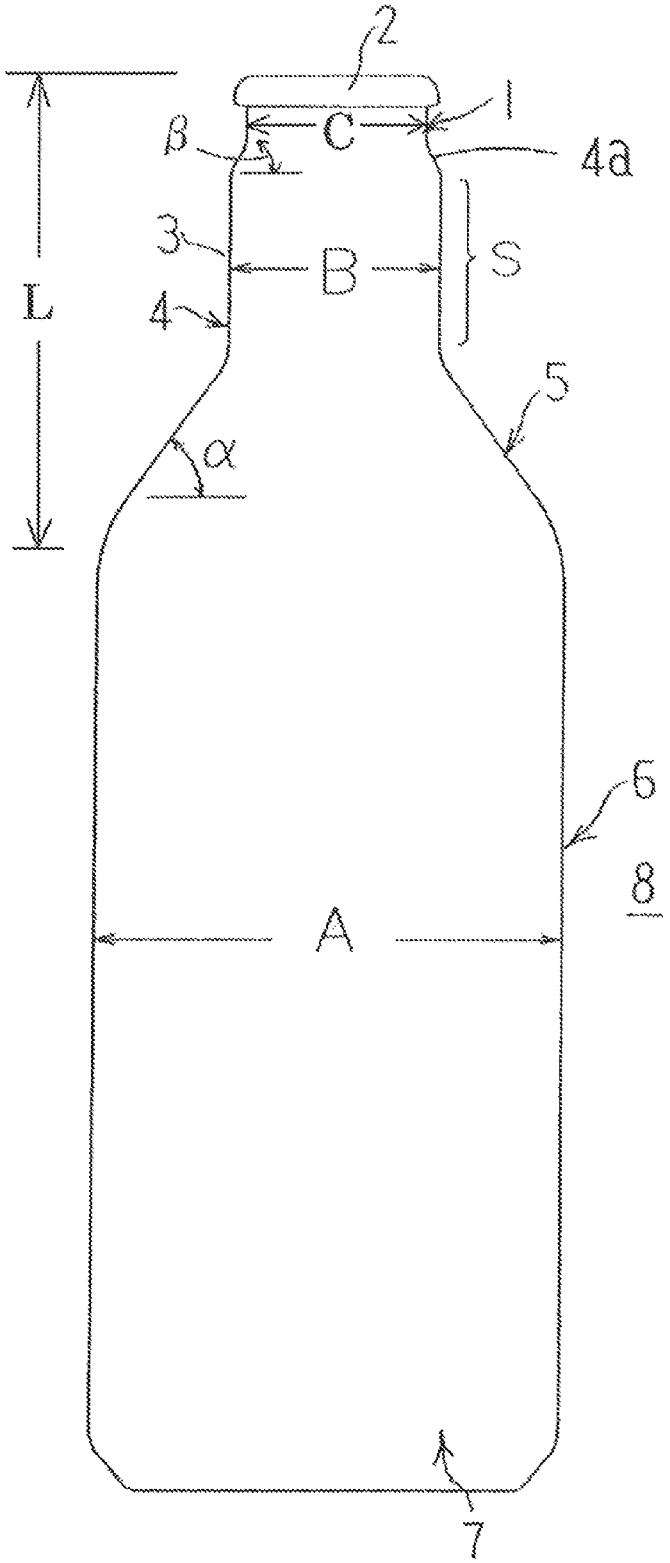
FIG. 1 is a front elevational view of the embodiment 1 of the metal bottle can of the present invention.

A metal bottle can 8 of FIG. 1 comprises a cylindrical barrel part 6, a bottom part 7 closing the lower end thereof, a taper-shaped shoulder part 5 formed in the upper end of the barrel part, a cylindrical neck part 4 formed in the upper end of the shoulder part, and a mouth part 1 formed in the upper end of the neck part through a taper portion 4*a*. A curl portion 2 is formed in the upper end of the mouth part.

Figure 5:
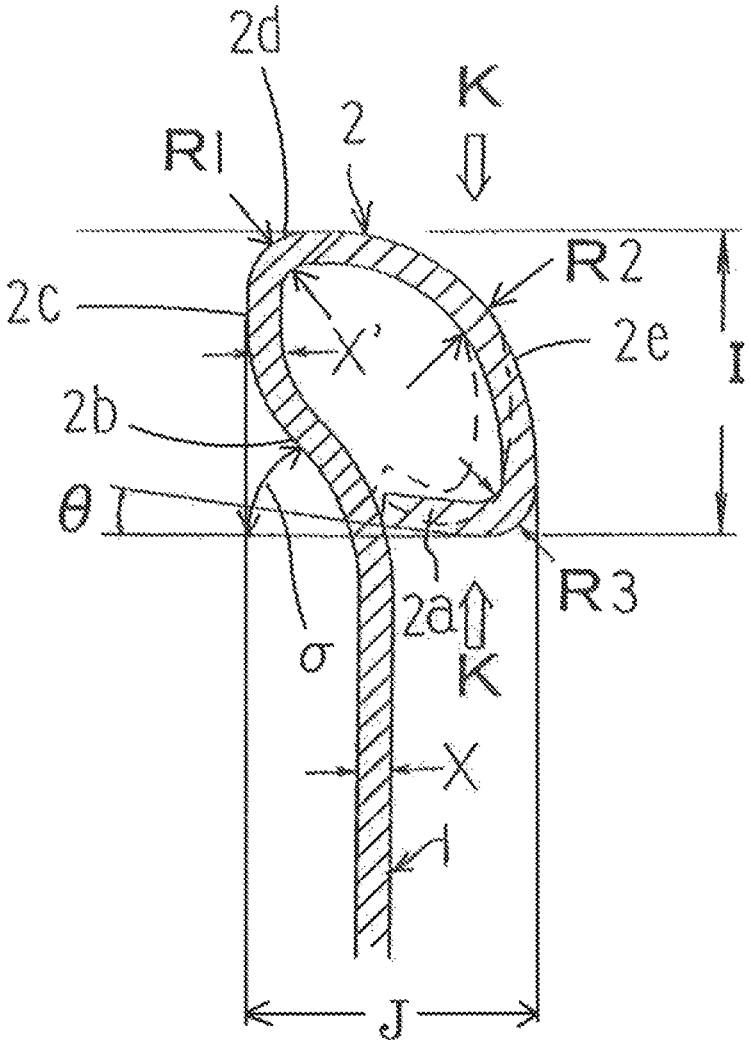
FIG. 5 is an expanded cross section view showing the curl portion of the mouth part of the metal bottle can of the present invention.

The curl portion 2 is roughly circular in the shape thereof as shown in FIG. 5, 6. The curled portion 2 has a diameter-contracted portion 2*b* where the diameter is contracted from the upper end of the mouth part, a standing-up portion 2*c* extending upward from the upper end of the diameter-contracted portion, an upper flexion portion 2*d* of the upper end of the standing-up portion, an outward protruded bend portion 2*e* expanding outward and extending downward smoothly from the upper flexion portion, a lower flexion portion 2*f* of the lower end of the bend portion, and a straight-line portion 2*a* extending straightly to the diameter-contracted portion from the lower flexion portion. The height L of the upper end (lower end of the shoulder part) of the barrel part from the upper end of the mouth part is 40 mm to 100 mm, preferably 50 mm to 86 mm (FIG. 1).

Figure 2:
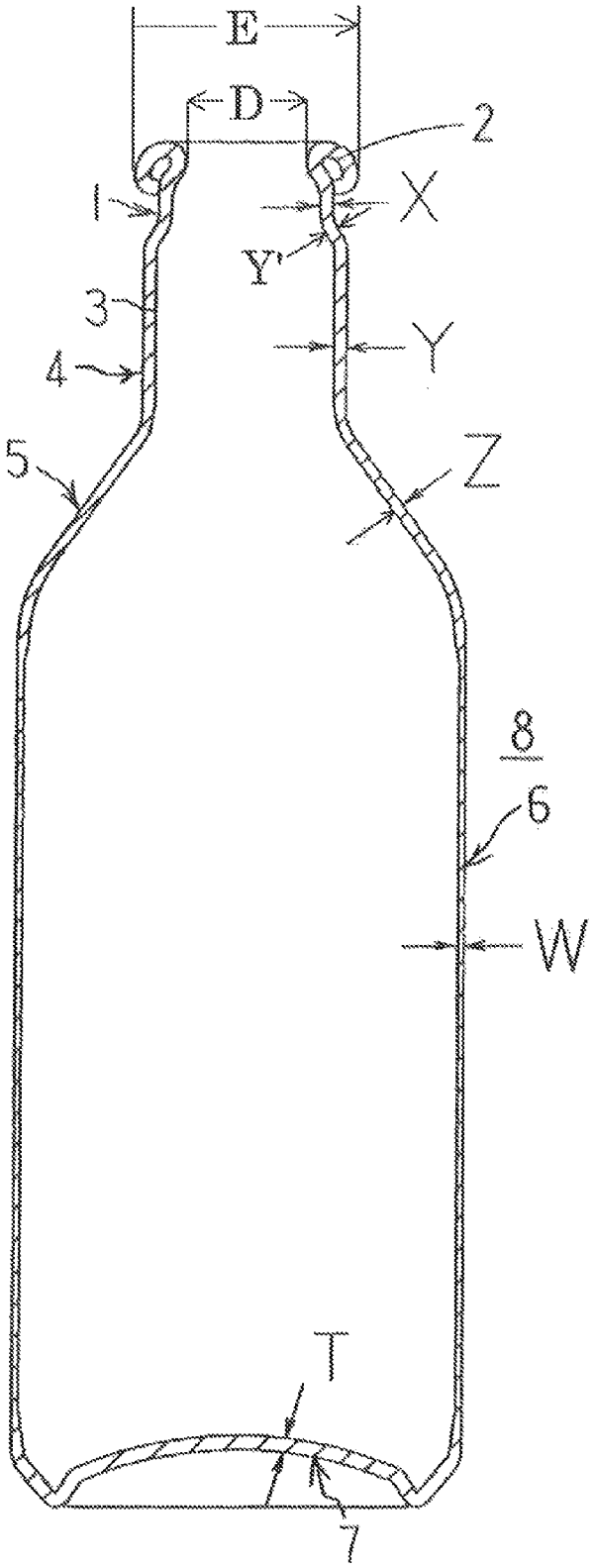
FIG. 2 is a front elevational cross section view of the embodiment 1 of the metal bottle can of the present invention.

The wall thickness T of the bottom part (primitive plate) is 0.48 mm to 0.30 mm, preferably 0.44 mm to 0.35 mm (FIG. 2). The diameter A of the barrel part is 40 mm to 70 mm, preferably 45 mm to 66 mm (FIG. 1). The wall thickness W of the barrel part is 0.22 mm to 0.12 mm, preferably 0.19 mm to 0.12 mm (FIG. 2). The angle α of the shoulder part is 40 degrees to 70 degrees, preferably 55 degrees to 62 degrees (FIG. 1). The wall thickness Z of the shoulder part is 0.33 mm to 0.20 mm, preferably 0.30 mm to 0.20 mm (FIG. 2). The diameter B of the neck part is 10 mm to 40 mm, preferably 22 mm to 29 mm (FIG. 1). The wall thickness Y of the neck part is 0.43 mm to 0.30 mm, preferably 0.41 mm to 0.32 mm (FIG. 2). The height S of the neck part is 10 mm to 37 mm (FIG. 1). The diameter C of the mouth part is 17 mm to 24 mm, preferably 22 mm to 24 mm (FIG. 1). The wall thickness X of the mouth part is 0.46 mm to 0.33 mm, preferably 0.44 mm to 0.35 mm (FIG. 2). The wall thickness X' of the curl portion is 0.48 mm to 0.35 mm, preferably 0.47 mm to 0.37 mm (FIG. 5). The inner diameter D of the curl portion is 22 mm to 17 mm, preferably 20.5 mm to 18.5 mm (FIG. 2). The outer diameter E of the curl portion is 28 mm to 26 mm, preferably 26.4 mm to 26.2 mm (FIG. 2). The height I of the curl portion is 6.0 mm to 3.0 mm, preferably 4.0 mm to 3.5 mm (FIG. 5). The width J of the curl portion is 5.0 mm to 2.0 mm, preferably 4.0 mm to 2.8 mm (FIG. 5). The diameter C of the mouth part/the diameter B of the neck part×100 is 65% to 100%, preferably 80% to 100%. The angle σ of the diameter-contracted portion is 25 degrees to 65 degrees, preferably 35 degrees to 50 degrees (FIG. 5). The curvature radius R1 of the upper flexion portion is 0.5 mm to 1.0 mm, preferably 0.6 mm to 0.9 mm (FIG. 5). The curvature radius R2 of the bend portion is 2.0 mm to 3.0 mm (FIG. 5). The curvature radius R3 of the lower flexion portion is 0.5 mm to 1.0 mm (FIG. 5). The angle θ of the straight-line portion against a horizontal line is 0 degree to 25 degrees, preferably 0 degree to 5 degrees, the angle θ' is 0 degree to minus 25 degrees, preferably 0 degree to minus 5 degrees (FIG. 5).

Figure 7:
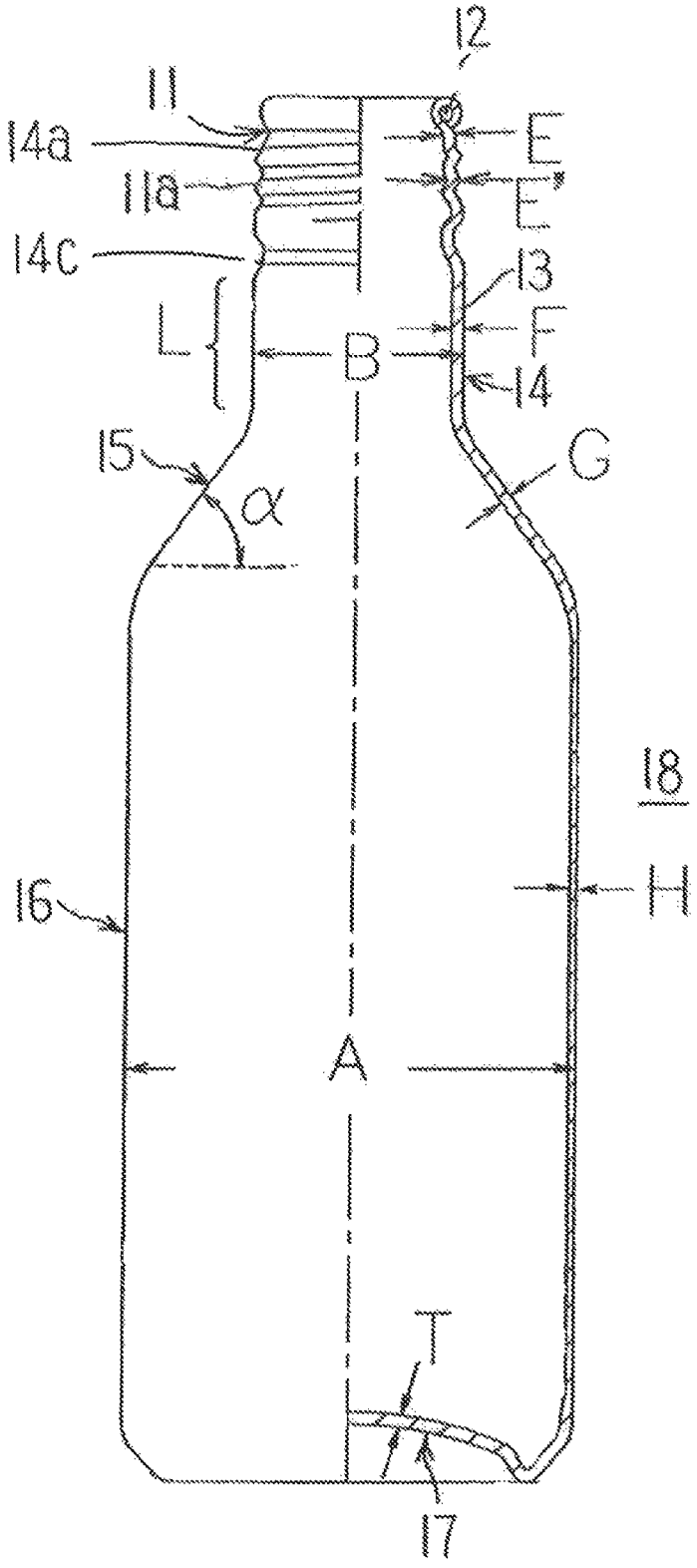
FIG. 7 is a partially cut-out cross section view showing the embodiment 2 of the metal bottle can of the present invention.

A metal bottle can 18 of FIG. 7 comprises a cylindrical barrel part 16, a bottom part 17 closing the lower end thereof, a taper-shaped shoulder part 15 formed in the upper end of the barrel part, a cylindrical neck part 14 formed in the upper end of the shoulder part, and a mouth part 11 formed in the upper end of the neck part through a taper portion 14*a*. A curl portion 12 is formed in the upper end of the mouth part. Moreover, a straight portion 13, a screw portion 11*a*, and an annular recessed portion 14*c* are formed in the neck part 14. This is that in which a screwing processing is applied to the neck part of the metal bottle can 1 of FIG. 1.

The wall thickness of the screw portion of the metal bottle can 18 is 0.42 mm to 0.32 mm, preferably 0.38 mm to 0.33 mm. Moreover, the wall thickness of the mouth part 11 is 0.45 mm to 0.35 mm, preferably 0.43 mm to 0.37 mm (FIG. 7). The other configuration is substantially same as that of the metal bottle can 1 of FIG. 1.

Figure 8:
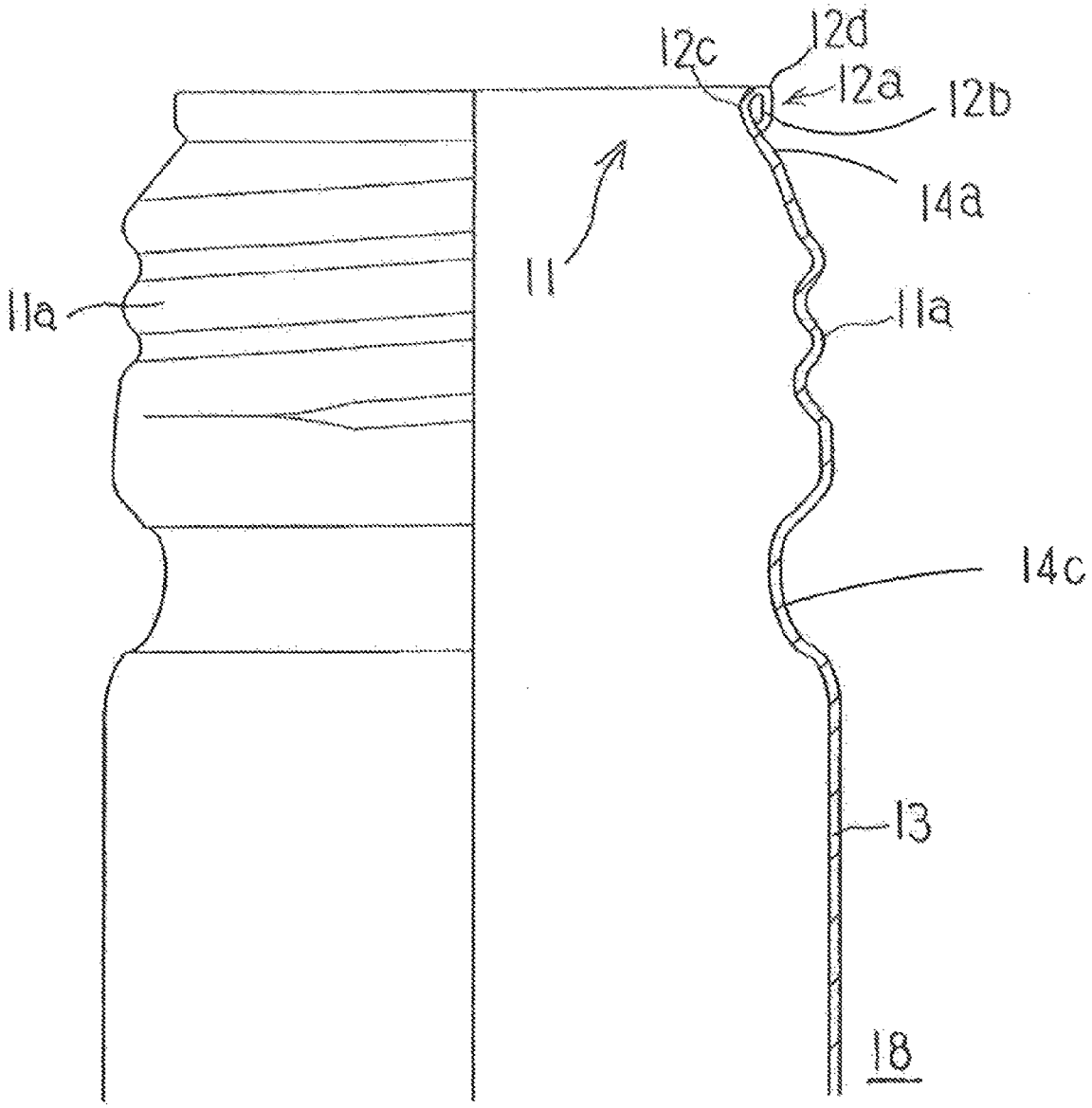
FIG. 8 is a partially cut-out cross section view showing the other embodiment of the embodiment 2 of the metal bottle can of the present invention.

In the metal bottle can of FIG. 8, a curl portion 12*a* is roughly semilunar. The curl portion is equipped with a semicircle portion 12*c* protruding outward from the upper flexion portion, and a planar portion 12*b* extending from the end portion straightly above and below from the end of the semicircle portion 12*c*, in place of the bend portion 2*e* of the curl portion. A protruded portion 12*d* is formed in the intersecting point of the semicircle portion 12*c* and the planar portion 12*b*. The mouth part 11 is also taper-shaped.

Figure 9:
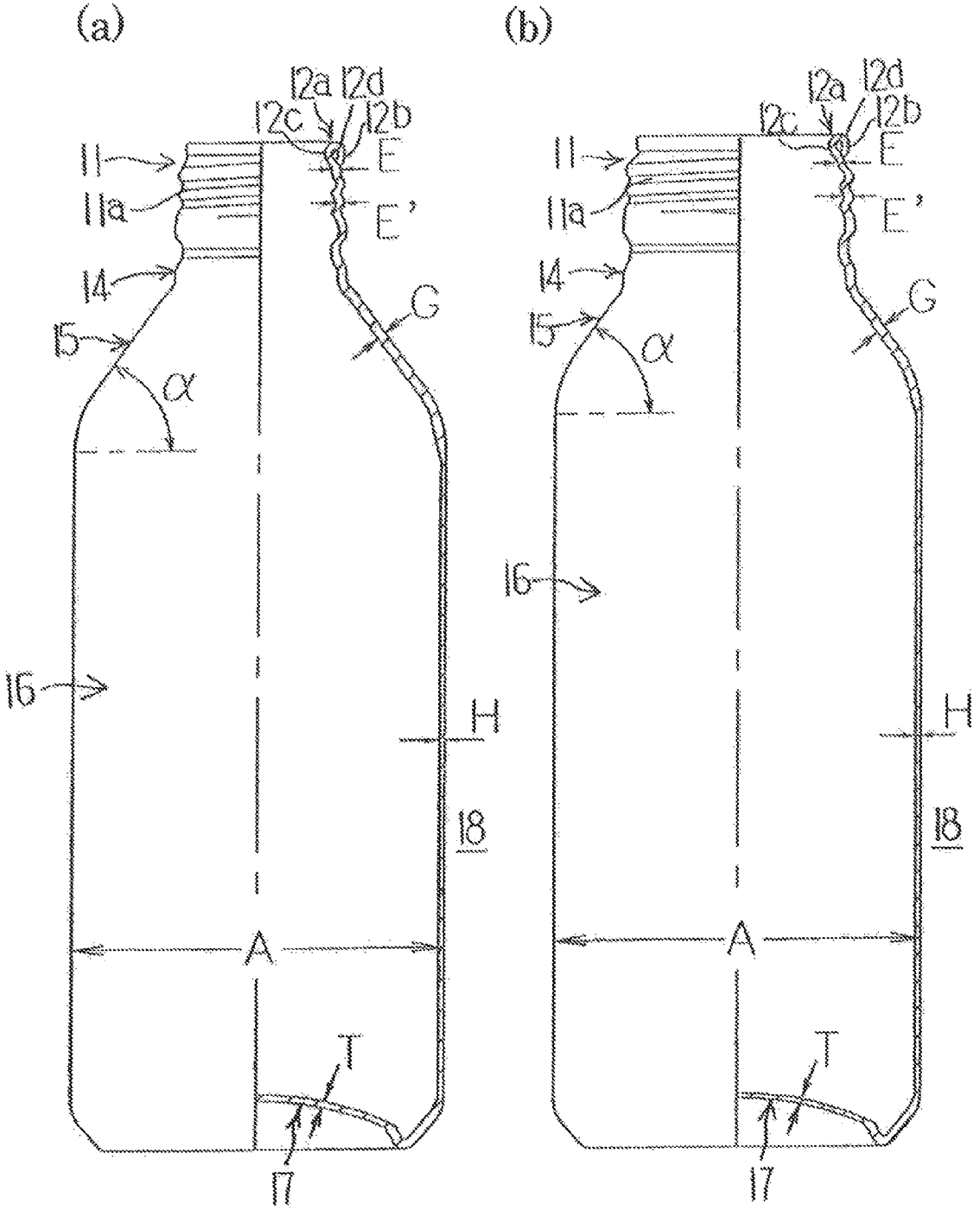
FIG. 9 is a front elevational view (a) (b) showing the other embodiment of the embodiment 2 of the metal bottle can of the present invention.

The metal bottle can of FIG. 9 is that in which the straight portion 18 is omitted from the metal bottle can of FIG. 7, and is equipped with a semilunar curl portion 12*a* of FIG. 8.

Figure 10:
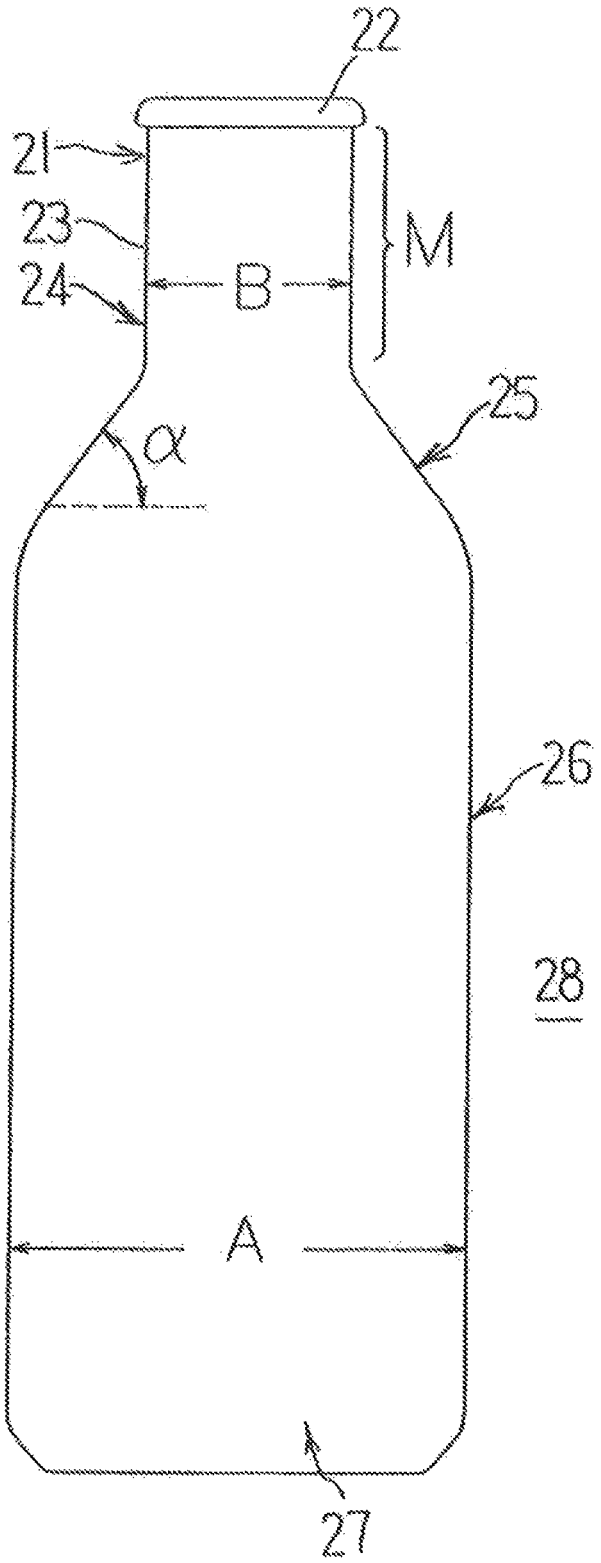
FIG. 10 is a front elevational view (a) (b) showing the embodiment 3 of the metal bottle can of the present invention.

The metal bottle can of FIG. 10 is that in which the neck part and the mouth part are unified, and is that in which the taper portion 4*a* of FIG. 1 is not equipped. In this embodiment 3, the height M of the neck part is 20 mm to 50 mm, preferably 20 mm to 45 mm.

Figure 11:
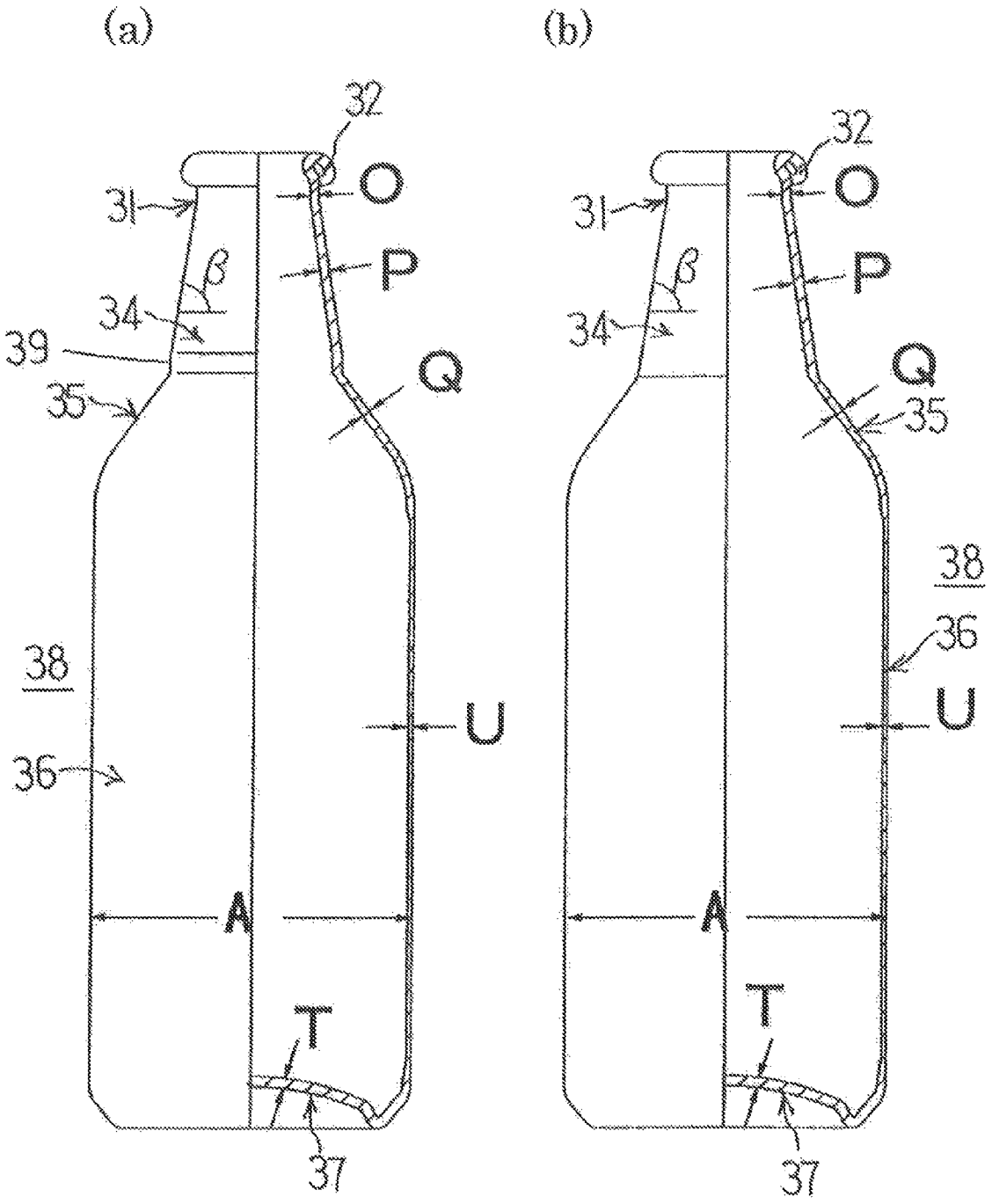
FIG. 11 is a partially cut-out cross section view (a) (b) showing the embodiment 4 of the metal bottle can of the present invention.

The metal bottle can of FIG. 11 comprises a cylindrical barrel part 36, a bottom part 37 closing the lower end thereof, a taper-shaped shoulder part 35 formed in the upper end of the barrel part, a cylindrical straight portion 39 formed in the upper end of the shoulder part, a taper-shaped neck part 34 formed in the upper end of the straight portion, and a mouth part 31 formed in the upper end of the neck part. A curl portion 32 is formed in the upper end of the mouth part.

Embodiment 1

Figure 3:
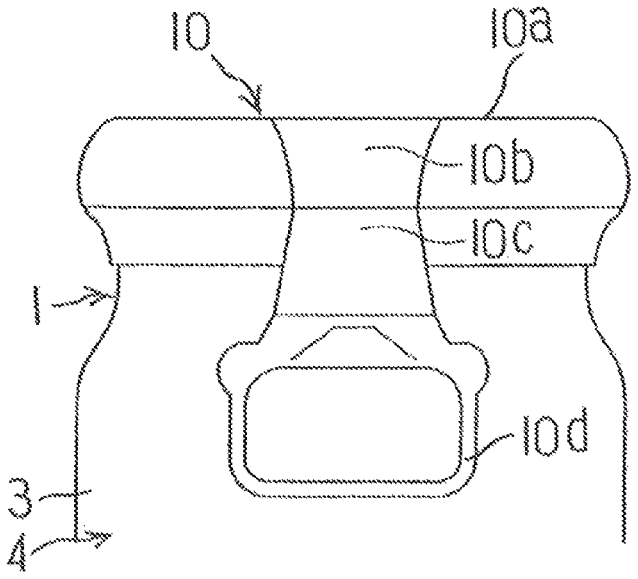
FIG. 3 is a front elevational view showing the case where an easily openable cap is wound and fastened to the curl portion of the mouth part of the metal bottle can of the present invention.
Figure 4:
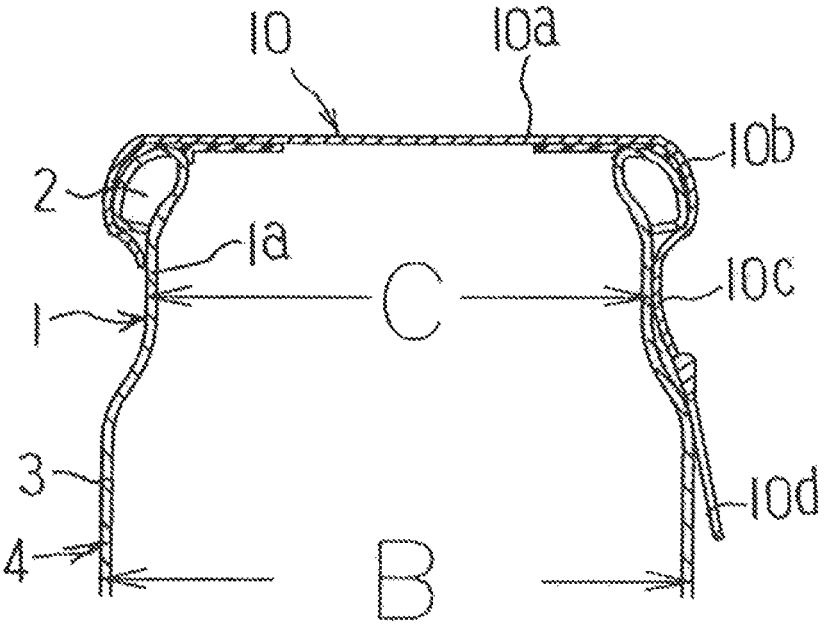
FIG. 4 is a cross section view showing the case where an easily openable cap is wound and fastened to the curl portion of the mouth part of the metal bottle can of the present invention.

FIG. 1 is a drawing showing the embodiment 1 of the present invention. In this metal bottle can 8, a curl portion 2 is formed in the end of the mouth part, and a straight portion 3 in parallel to the can axis is formed down below the mouth part 1 in the neck part. It is characterized in that the metal bottle can 8 has a long neck part 4. By the formation of the straight portion 3, the metal bottle 8 becomes easy to hold and easy to handle. And, the mouth part 1, neck part 4, shoulder part 5, barrel part 6, and bottom part 7 are integrally formed. The embodiment 1 is formed by drawing a primitive plate (wall thickness T) having thickness of 0.44 mm. The embodiment 1 is formed to have the barrel part with diameter A of 60 mm, the neck part with diameter B of 27 mm and length S of 25 mm, and the shoulder part with the angle α of 54.5 degrees. Further, the embodiment is formed to have the mouth part with the wall thickness X of 0.43 mm, and the straight portion of the neck part with the wall thickness Y of 0.40. The embodiment is formed to have the tapered-shaped shoulder part with a wall thickness Z of 0.29 mm, and the barrel part with the wall thickness W of 0.18 mm. The inventors etc. have found that even if the wall thickness of the barrel part 6 is thinner than that of the curl portion 2 and the neck part 4, the metal bottle can will have sufficient strength to withstand the load, and that the cost will be reduced by thinning. As other embodiments, the primitive plate of the wall thickness of 0.40 mm, 0.38 mm, 0.36 mm etc. may be drawing processed. In this case, it goes without saying that the weight reduction and cost reduction are further attained by the using thinner primitive plate and maintains the strength. In addition, other than 3104-H19, 3004, 3204 etc. may be used as the plate material of aluminum alloy for the present invention, As shown in FIG. 3 and FIG. 4, an easily openable cap 10 called maxi cap, rip cap etc. in popular name is wound and fastened to the curl portion 2. If the withstanding strength of the curl portion is insufficient, the curl portion 2 will deforms as shown by the dashed line, because of a pressing force applied to the curl portion 2 when the easily openable cap 10 is wounded and fastened. In such a case, there is a problem that the content leaks from the gap between the curl portion 2 and the easily openable cap 10. In the metal bottle can 8 of the embodiment 1, as shown in FIG. 5, the curl portion 2 of the end of the mouth part 1 is formed to be thick with the wall thickness X' of 0.46 mm. The inventors etc. have found that when the curl portion 2 is prepared with the above thickness, no deformation will be generated in the curl portion 2 (like of dashed line of FIG. 5) and the neck part 4 will not deform into the shape of ellipse etc. during the wounding and fastening of the easily openable cap 10 suitable for the curl portion 2 having outer diameter of 26.3 mm. In other words, the inventors etc. have specified the range of the wall thickness where it is possible to attain the balance of thinning and weight reduction, while maintaining the strength of the curl portion 2. The specified range of the metal bottle can is that the size B of the neck part 4 is 20 mm to 35 mm, the outer diameter A of the barrel part 6 is 40 mm to 70 mm, the angle α of the shoulder part is 40 degrees to 70 degrees.

Next, the inventors etc. also have focused on the shape of the curl portion 2 itself as much as the wall thickness X' of the curl portion 2 having strength which withstand the loads. The inventors found that the strength of the curl portion can withstand the load (arrow head K=about 1600 N) which crushes the curl portion 1 in the can axis direction, when the straight-line portion 2*a* of the curl portion 2 extending upward from a horizontal line has the angle θ to be as small as $0 \leq \theta \leq 25$ degrees and when the lower portion of the curl portion 2 has the curvature radius R to be as small as 0.5 mm≤R3≤1.0 mm.

Figure 6:
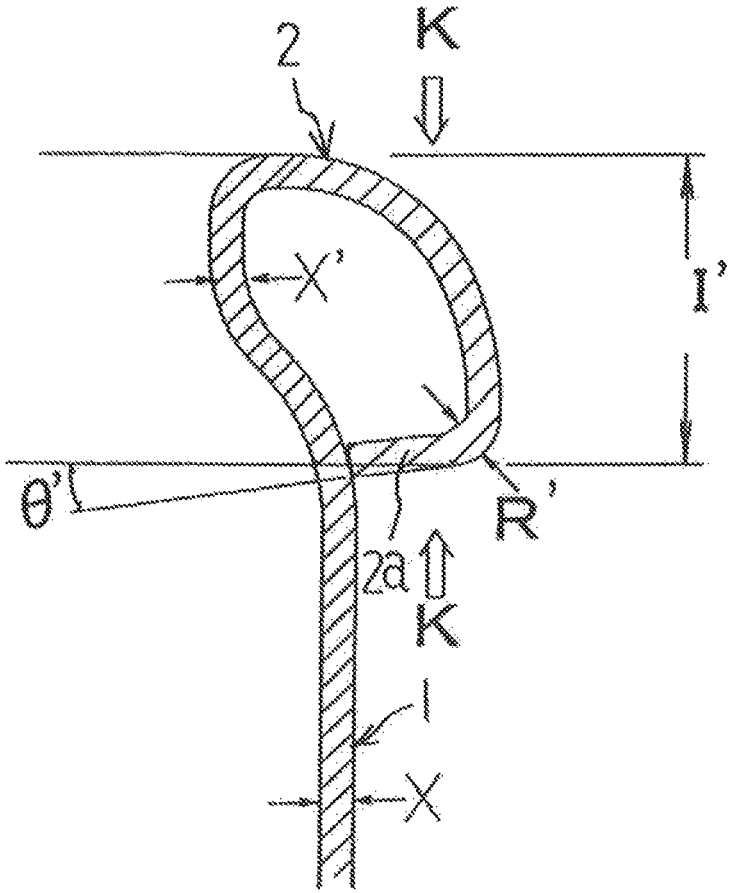
FIG. 6 is an expanded cross section view showing the other embodiment of the curl portion of the mouth part of the metal bottle can of the present invention.

FIG. 6 shows the other example of the curl portion 2 which does not deform. The curl portion 2 of the FIG. 6 can withstand the load (arrow head K=about 1600 N) which crushes the curl portion in the can axis direction caused by the wounding and fastening of the easily openable cap 10, when the straight-line portion 2*a* of the curl portion 2 extending downward from a horizontal line has the angle θ to be as small as 0≤θ≤25 degrees and when the lower portion of the curl portion 2 has the curvature radius R to be as small as 0.5 mm≤R3≤1.0 mm.

If the range of θ, θ', R, and R' is determined as described above, and the shape of the curl portion 2 is to be held as described above, the size of the curl height I, I' can be stabilized. Hence, it is possible to prevent the content to leak from between the curl portion 2 and the easily openable cap 10, if the size of the curl height I, I' is stabilized. For reference's sake, a pressure at which the content leaks from the easily openable cap 10 which is wound and fastened to the mouth part 1 of the metal bottle can of the embodiment 1 is 1.2 MPa or more.

Further, in the embodiment 1, the size of the mouth part 1 shown in FIG. 4 is C=23.1 mm, where the diameter is contracted from the size B=27 mm of the straight portion 3 of the neck part 4. This configuration makes it possible to prevent a pull tab 10*d* of the easily openable cap 10 from protruding in a large way from the periphery of the size B of the neck part 4. The tongue piece connecting a skirt portion 10*b* extending downward from the top face wall 10*a* of the easily openable cap and a pull tab 10*d* is closely attached to the annular recessed portion 1*a* of the mouth part 2 of which the diameter is contracted. Therefore, it can prevent the pull tab 10*d* from catching, in each stage of transportation, sale, or consumption of the metal bottle can because the pull tab 10*d* is prevented to protrude largely from the neck part 4. Moreover, a winding and fastening claw (not shown in the figure) can be easily let into the recessed portion 1*a*. Therefore, when the easily openable cap 10 is wound and fastened to the curled portion 2, the tip of the winding and fastening portion of the easily openable cap 10 can be securely contacted to the lower side of the curl portion 2. It is preferable to satisfy the equation of size C/size B=65%-100%.

In the method for manufacturing the metal bottle can of the embodiment 1, a plate material of aluminum alloy, for example, the plate material of 3104-H19 is drawing processed first to form a bottomed cylindrical body having a barrel part. After that, necking processing is applied to the opening of the bottomed cylindrical body to form the planned forming portion of a mouth part and neck part having a straight portion. Then, a mouth part is formed by contracting the diameter of the upper portion of the planned forming portion. Next, a curl portion is formed in the end of the mouth part to complete. After a content is filled in the metal bottle can, an easily openable cap is wound and fastened to the curl portion.

On the other hand, in the case of a metal bottle can having a screw formed in the lower portion of the mouth part of the embodiment 2. Similarly, the planned forming portion having the mouth part and the neck part having a straight portion is formed. And, while a male screw processing is applied to the planned forming portion beneath the mouth part, a curl processing is applied to the end of the mouth part to complete. After a content is filled in the metal bottle can, a cap cylinder body of cylindrical shape is covered on the mouth part, and a male screw is formed in the side face of the cap cylinder body by a screw forming machine. Stated differently, the top face of the planned cap cylinder body is pressed downward in the can axis direction using a pressure block, and a thread cutting roller is pressed around the can along the male screw of the mouth part of the metal bottle can to form a screw cap.

Embodiment 2

FIG. 7 is a drawing showing the embodiment 2 of the present invention.

In a metal bottle can 18 of the embodiment 2, a curl portion 12 is formed in the end of a mouth part 11 and a male screw portion 11*a* is formed beneath the curl portion 12. Moreover, in the lower portion thereof, it has a straight portion 13 in parallel to the can axis. It is characterized in that a neck part 14 is formed long. Forming of the straight portion 13 allows easy holding and easy handling of the metal bottle can 18. The point that a mouth part 11, neck part 14 having the straight portion 13, a taper-shaped shoulder part 15, a barrel part 16, and a bottom part 17 are formed by integral molding is same as the embodiment 1.

In the embodiment 2, the embodiment 2 is formed by drawing a primitive plate (wall thickness T) having thickness of 0.44 mm similar to the embodiment 1. The embodiment 2 is formed to have the barrel part with diameter A of 60 mm, the neck part with diameter B of 27 mm and length L of 20 mm, and the shoulder part with the angle α of 54.5 degrees. Further, the embodiment 2 is formed to have the mouth part with the wall thickness E of 0.41 mm, the screw portion with the wall thickness E' of 0.38 mm, and the straight portion 13 of the neck part 14 with the wall thickness F of 0.37.

In addition, as the other example of the metal bottle can 18 of the embodiment 2, as shown in FIG. 8, a semilunar curl portion 12*a*, of which the cross section of the curl portion is not circular as shown in FIG. 7, may be formed. In this semilunar curl portion 12*a*, a planar portion 12*b* is formed in outside periphery thereof, and a semicircular portion 12*c* is formed from the top of the planar portion 12*b* to the top face including the inner perimeter of the top face. And a protruded portion 12*d* is formed at the intersecting point of the planar portion 12*b* and the semicircular portion 12*c*. The function of this semilunar curl portion 12*a* exists in the point that, when the mouth part 11 of the metal bottle can 18 is sealed by a screw cap, the protruded portion 12*d* bites into the packing of the cap, and the surface of the planar portion 12*b* strongly presses the packing making a firm sealing between the mouth part 11 and the cap. Accordingly, the quality of the content can be held even when a content having inner pressure is filled in.

Moreover, in the metal bottle 18 can of the mouth part 11 and the neck part 14 having the size of the embodiment 2, the depression of the screw portion 11*a* and the shoulder part 15, and the buckling etc. of the barrel part 16 can be prevented by forming the wall thickness G of the taper-shaped shoulder part 15 into 0.28 mm, and the wall thickness H of the barrel part into 0.18 mm, during the thread cutting process of the screw portion 11*a* of the capping processing where the metal bottle can receives the downward pressure in the can axis of the pressure block of about 1050 N. In other words, the balance of thinning and weight reduction can be attained, while maintaining the strength of the mouth part 11 and the screw portion 11*a*.

The inventor has specified the wall thickness of the mouth part 11 and the screw portion 11*a* of the metal bottle can 18 of this embodiment 2. The metal bottle can 18 of the embodiment 2 is formed to have the tapered-shaped shoulder part with the wall thickness G of 0.33 mm-0.20 mm, and the barrel part with the wall thickness H of 0.22 mm-0.12 mm.

Further, the other example of the embodiment 2 is shown in FIG. 9.

The embodiment of FIG. 9 is characterized in that the neck part 14 does not have a straight portion in parallel to the can axis. Even when the straight portion does not have the straight portion, each size of the mouth part 11, the male screw portion 11*a*, the neck part 14, and the shoulder part 15, the angle α, as well as the outer diameter of the mouth part 11 and the neck part 14 with regard to the barrel part 16 are specified so that the metal bottle can 18 is still easy to hold and easy to handle. The metal bottle can 18 of this embodiment having the mouth part 11, the neck part 14, the taper-shaped shoulder part 15, the barrel part 16, and the bottom part 17 is integrally formed by drawing processing the similar primitive plate (wall thickness T) of the thickness 0.44 mm. The diameter A of the barrel part is 60 mm, the outer diameter of the mouth part is 28 mm (Figure a) or 38 mm (Figure b), the angle α of the shoulder part is 54.5 degrees. Further, the wall thickness E of the mouth part is 0.41 mm, the wall thickness E' of the screw portion is 0.38 mm. The semilunar curl portion 12*a* is formed similarly in the end of the mouth part 11 of the metal bottle can 18, and, the male screw portion 11*a* is formed beneath the curl portion 12*a*. In this semilunar curl portion 12*a*, a planar portion 12*b* is formed in outside periphery, and a semicircular portion 12*c* is formed from the top of the planar portion 12*b* to the top face including the inner perimeter of the top face. And a protruded portion 12*d* is formed at the intersecting point of the planar portion 12*b* and the semicircular portion 12*c*. In addition, it goes without saying that the wall thickness G of the shoulder part 15 and the wall thickness H of the barrel part are sufficient to withstand the pressure block pressure when in the processing and the buckling when in the thread cutting.

Embodiment 3

FIG. 10 is a drawing showing the embodiment 3 of the present invention.

The metal bottle can 28 is characterized in that, a curl portion 22 is formed in the end of a mouth part 21, and a neck part 24 having a straight portion 23 in parallel to the can axis is formed to be long. The metal bottle can having the mouth part 21, the neck part 24, a shoulder part 25, a barrel part 26, and a bottom part 27 are integrally formed. In the embodiment 3, the wall thickness of the primitive plate which will be drawing processed, the diameter A of the barrel part 26, the diameter B of the neck part 24, the angle α of the shoulder part 25, the wall thickness of the mouth part 21, the wall thickness of the neck part 24 are same as those of the embodiment 1. Moreover, the wall thickness of the taper-shaped shoulder part 25 and the wall thickness of the barrel part 26 are also formed to be same as the embodiment 1. The point different from the embodiment 1 is that the length M of the straight portion of the neck part is 35 mm, and that the diameter of the upper portion of the neck part 24 is not contracted.

Embodiment 4

FIG. 11 is a drawing showing the embodiment 4 of the present invention.

This metal bottle can 38 is characterized in that, while a curl portion 32 is formed in the end of the mouth part 31, it has a taper shape of angle β from beneath a mouth part 31 to a shoulder part 35*a*. In the embodiment 4, the mouth part 31, the neck part 34, a shoulder part 35, a barrel part 36, and a bottom part 37 are integrally formed similarly by drawing processing the primitive plate (wall thickness T) of the thickness 0.44 mm. The diameter A of a barrel part 36 is 60 mm, the angle β of the neck part 34 is 50 degrees to 89 degrees. The wall thickness O of the mouth part is 0.43 mm, the wall thickness P of the taper-shaped neck part 34 is 0.40 mm, further, the wall thickness Q of the shoulder part 35 is 0.29 mm, and the wall thickness U of the barrel part 36 is 0.18 mm. In this embodiment 4, the easily openable cap is wound and fastened to the curl portion 32 to close the mouth part 31. The difference of the embodiment between the Figure (a) and Figure (b) of FIG. 11 is that the embodiment of Figure (a) of FIG. 11 somewhat has the straight portion 39 in parallel to the can axis between the neck part 34 and the shoulder part 35, but the embodiment of Figure (b) of FIG. 11 do not have the straight portion in parallel to the can axis.

In addition, the embodiment 2, the embodiment 3, and the embodiment 4 is a thinned metal bottle can 38, which has sufficient strength to withstand against a load applied when in forming the curl portion, a load applied when in capping the screw cap, or a load applied when in winding and fastening the easily openable cap. Further, it goes without saying that these are reasonable metal bottle cans 38 which have sufficient strength not to generate deformation, buckling of the mouth part, the neck part or the barrel part in the manufacturing, filling process, while the balance of thinning and weight reduction being attained.

INDUSTRIAL APPLICABILITY

Since the metal bottle can of the present invention is a low cost metal bottle can in which the balance of thinning and weight reduction is attained while maintaining the strength. It can be widely used as a container for filling carbonated beverages such as beer, cola etc., refreshing liquids such as juice, tea etc., foods, health drinks, and medicals.

The invention claimed is:

1. A metal bottle can comprising a mouth part having a curl portion at an end, a neck part having a straight portion in parallel to a can axis, a shoulder part having a tapered shape, a barrel part, and a bottom part, wherein the curl portion has a diameter-contracted portion extending inwardly and upwardly at an upper end of the mouth part, said diameter-contracted portion having a diameter that is contracted as compared to a diameter of the straight portion of the neck part, a standing-up portion extending upward from an upper end of the diameter-contracted portion, an upper flexion portion formed on an upper end of the standing-up portion, an outward protruded bend portion expanding outward and extending downward smoothly from the upper flexion portion, a lower flexion portion formed on a lower end of the bend portion, and a straight-line portion extending straightly inwardly to the diameter-contracted portion from the lower flexion portion, wherein a diameter A of the barrel part is 40 mm to 70 mm, a diameter B of the neck part is 20 mm to 35 mm, a length S of the straight portion of the neck part is 10 mm to 40 mm, an angle α of the shoulder part is 40 degree to 70 degree, a wall thickness X of the mouth part is 0.46 mm to 0.33 mm, and a wall thickness Y of the straight portion of the neck part is 0.43 mm to 0.30 mm, and wherein the metal bottle can is integrally formed by drawing a primitive plate of thickness (wall thickness T) of 0.48 mm to 0.30 mm.

2. A metal bottle can according to claim 1, wherein a wall thickness Z of the shoulder part is 0.22 mm to 0.12 mm and a wall thickness W of the barrel part is 0.22 mm to 0.12 mm.

3. A metal bottle can according to claim 1, wherein a wall thickness X' of the curl portion is 0.48 mm to 0.35 mm, an angle θ between a straight line portion of the curl portion and the horizontal line of the curl portion is $0 \leq \theta \leq 25$ degrees, a radius of a curvature R of a lower portion of the curl portion is 0.5 mm$\leq$R$\leq$1.0 mm, or wherein a wall thickness X' of the curl portion is 0.48 mm to 0.35 mm, an angle θ' between a straight line portion of the curl portion and the horizontal line of the curl portion is $0 \leq \theta' \leq 25$ degrees, a radius of a curvature R' of a lower portion of the curl portion is 0.5 mm≤R'≤1.0 mm.

4. A metal bottle can according to claim 1, wherein an easily openable cap is wound and fastened to the curl portion.

5. A metal bottle can according to claim 1, wherein an outer diameter C of a recessed portion of the mouth part is smaller than a diameter B of the straight portion of the neck part, so that a tongue piece which connects a top surface wall of an easily openable cap and a pull tab is along a wall surface of the recessed portion of the mouth portion of the metal bottle can.

6. A metal bottle can according to claim 1, wherein a diameter of the straight portion of the neck part is lengthened to the lower portion of the curl portion.

7. A metal bottle can according to claim 1, wherein a tapered portion is formed between the neck part and the mouth part.

8. A metal bottle can comprising a mouth part having a curl portion at an end and a male screw portion formed at a periphery, a neck part having a straight portion in parallel to a can axis, a shoulder part having a tapered shape, a barrel part, and a bottom part, wherein the curl portion has a diameter-contracted portion extending inwardly and upwardly at an upper end of the mouth part, said diameter-contract portion having a diameter that is contracted as compared to a diameter of the straight portion of the neck part, a standing-up portion extending upward from an upper end of the diameter-contracted portion, an upper flexion portion formed on an upper end of the standing-up portion, an outward protruded bend portion expanding outward and extending downward smoothly from the upper flexion portion, a lower flexion portion formed on a lower end of the bend portion, and a straight-line portion extending straightly inwardly to the diameter-contracted portion from the lower flexion portion, wherein a diameter A of the barrel part is 40 mm to 70 mm, an angle $\alpha$ of the shoulder part is 40 degree to 70 degree, a wall thickness E of the mouth part is 0.45 mm to 0.32 mm, and a wall thickness F of the straight portion of the neck part is 0.40 mm to 0.30 mm, and wherein the metal bottle can is integrally formed by drawing a primitive plate of thickness (wall thickness T) of 0.48 mm to 0.30 mm.

9. A metal bottle can according to claim 8, wherein the metal bottle can has a neck part which does not have a straight portion in parallel to the can axis.

10. A metal bottle can according to claim 8, wherein a wall thickness G of the shoulder part having the tapered shape is 0.33 mm to 0.20 mm, and a wall thickness H of the barrel part is 0.22 mm to 0.12 mm.

11. A metal bottle can comprising a mouth part having a curl portion at an end, a neck part having a straight portion in parallel to a can axis, a shoulder part having a tapered shape, a barrel part, and a bottom part, wherein the curl portion has a diameter-contracted portion extending inwardly and upwardly at an upper end of the mouth part, said diameter-contracted portion having a diameter which is contracted as compared to a diameter of the straight portion of the neck part, a standing-up portion extending upward from an upper end of the diameter contracted portion, an upper flexion portion formed on an upper end of the standing-up portion, an outward protruded bend portion expanding outward and extending downward smoothly from the upper flexion portion, a lower flexion portion formed on a lower end of the bend portion, and a straight-line portion extending straight inwardly to the diameter-contracted portion from the lower flexion portion, wherein the metal bottle can is integrally formed by drawing a primitive plate of a predetermined thickness.

12. A metal bottle can according to claim 11, wherein a tapered portion is formed between the neck part and the mouth part.

13. A metal bottle can according to claim 12, wherein a diameter of the straight portion of the neck part is lengthened to a lower portion of the curl portion.

* * * * *